US008245498B2

(12) United States Patent
Liu et al.

(10) Patent No.: US 8,245,498 B2
(45) Date of Patent: Aug. 21, 2012

(54) APPARATUS AND METHOD TO CONTROL ENGINE CRANKCASE EMISSIONS

(75) Inventors: Z. Gerald Liu, Madison, WI (US); Kelly R. Schmitz, Cottage Grove, WI (US); Brian W. Schwandt, Fort Atkinson, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 828 days.

(21) Appl. No.: 12/142,985

(22) Filed: Jun. 20, 2008

(65) Prior Publication Data

US 2009/0313977 A1 Dec. 24, 2009

(51) Int. Cl.
*F01N 3/00* (2006.01)

(52) U.S. Cl. ..... 60/283; 60/291; 60/311

(58) Field of Classification Search ..... 60/281, 60/283, 299, 311
See application file for complete search history.

(56) References Cited

U.S. PATENT DOCUMENTS

| | | | | |
|---|---|---|---|---|
| 6,143,049 | A * | 11/2000 | Gieseke et al. | 55/385.3 |
| 6,161,529 | A | 12/2000 | Burgess | |
| 6,412,477 | B2 * | 7/2002 | Saruwatari et al. | 123/520 |
| 6,701,902 | B2 | 3/2004 | Koyama et al. | |
| 6,735,940 | B2 | 5/2004 | Stroia et al. | |
| 6,745,560 | B2 | 6/2004 | Stroia et al. | |
| 6,820,414 | B2 | 11/2004 | Stroia et al. | |
| 6,907,869 | B2 | 6/2005 | Burgess et al. | |
| 7,238,216 | B2 | 7/2007 | Malgorn et al. | |
| 2006/0254426 | A1 * | 11/2006 | Liu et al. | 96/154 |
| 2007/0062886 | A1 | 3/2007 | Rego et al. | |
| 2007/0107396 | A1 * | 5/2007 | Zuberi | 55/523 |
| 2007/0144348 | A1 * | 6/2007 | Gieseke et al. | 95/287 |
| 2007/0160510 | A1 * | 7/2007 | Schultz et al. | 422/177 |
| 2008/0035103 | A1 * | 2/2008 | Barris et al. | 123/198 E |
| 2008/0245037 | A1 * | 10/2008 | Rogers et al. | 55/385.3 |

FOREIGN PATENT DOCUMENTS

| | | | |
|---|---|---|---|
| JP | 2006-152890 | A | 6/2006 |
| WO | WO 2004/045743 | A1 | 6/2004 |

OTHER PUBLICATIONS

Sato et al. "Calculation Method of Adsorption and Desorption Performance of Butane Gas in Carbon Canister". SAE Paper 2008-01-0625, SAE International, 2008.

International Search Report of PCT/US2009/043618, dated Dec. 24, 2009.

Written Opinion of the International Searching Authority of PCT/US2009/043618, dated Dec. 24, 2009.

* cited by examiner

*Primary Examiner* — Thomas Denion
*Assistant Examiner* — Patrick Maines
(74) *Attorney, Agent, or Firm* — Hamre, Schumann, Mueller & Larson, P.C.

(57) ABSTRACT

An apparatus for reducing crankcase emissions generated by an engine is described. The apparatus generally includes a separator that removes particulate matter from the crankcase emissions and a treatment component that removes odor and gases from the crankcase emissions. The apparatus is configured where the treatment component is disposed downstream of the separator, the separator first removes particulate matter from the crankcase emissions and the treatment component then removes odor and certain gases from the crankcase emissions.

18 Claims, 3 Drawing Sheets

APPARATUS AND METHOD TO CONTROL ENGINE CRANKCASE EMISSIONS

FIELD

An apparatus is disclosed that can generally reduce crankcase emissions generated by an engine, including certain particulate matter, odor, and/or toxic exhaust gases, and by using for example various filtration, coalescing, and catalytic mechanisms.

BACKGROUND

Crankcase filtration assemblies are widely known and used in a number of engine applications, such as engine aerosol and oil filtration. For example, during the combustion process in a spark ignited or compression ignition engine, compression gases and other byproducts of combustion may enter into an engine's crankcase. This condition is called blow-by. At this time, gas pressure develops in the crankcase that is above atmospheric pressure. Due to the pressure increase, the blow-by gases are ventilated from the engine crankcase through openings, which are usually located in a valve cover assembly or upper engine block area. These blow-by gases contain various particulate matter, odor, and toxic exhaust gases as crankcase emissions. When the crankcase ventilates into the surrounding environment it is known as open crankcase ventilation (OCV). Over time, the blow-by flow rate increases. As a result, a blow-by gas stream may be carrying an increased amount of particulate matter, odor, and toxic exhaust gases.

In general, crankcase ventilation filtration typically occurs through a process known as separation, for example through a coalescer element and/or impactor element. Generally, separation structures are configured to separate condensates from the blow-by gas stream. When a coalescer element is employed, smaller particles may be separated from the blow-by gas stream and coalesce into larger particles to help remove such particulate matter from the blow-by gas stream. To aid in the coalescing process, crankcase filtration assemblies often employ a media structure that collects the smaller particles. In the example of an impactor element, a structure is employed that gets in the way of, or impacts the blow-by gas stream to trap more coarse particulate matter.

Beginning in 2007, crankcase emissions have been counted toward total engine emission levels. In certain situations, the crankcase emissions from older and less maintained engines were found to contribute the majority of the total unregulated toxic emissions. Current emission control products for crankcases employ separation structures that are designed to mainly reduce coarse particulate matter (PM) emissions. Such PM emissions typically are mechanically generated with a size range of larger than 0.5 micron. While it is important to control large PM emission in order to reduce the total PM mass emissions, studies show crankcases emit significant amounts of chemically and thermally generated ultra-fine PM (about<0.5 micron), gases, odor, and unregulated toxic species.

Improvements may be made upon existing emission control products where crankcase gases are emitted to the atmosphere, and particularly in products for open crankcase ventilation systems.

SUMMARY

The following technical disclosure describes a unique apparatus that can generally reduce crankcase emissions generated by an engine, including particulate matter, odor, and/or toxic exhaust gases. The apparatus may be employed in an emissions system, for instance open crankcase ventilation emission systems of various engines, including compression ignition and spark ignited internal combustion engines, to reduce emissions in a blow-by gas stream.

The apparatus generally includes a separator that first removes particulate matter from the crankcase emissions and a treatment component downstream from the separator that reduces odor and removes certain toxic gases from the crankcase emissions. The apparatus may employ various separation mechanisms including filtration, coalescing, and impactor structures, and also may employ various catalytic mechanisms. Such separation and catalytic mechanisms may be employed in a number of configurations and arrangements to accomplish reducing and controlling such engine crankcase emissions.

In one embodiment, an apparatus for reducing crankcase emissions generated by an engine includes an inlet configured to receive crankcase emissions from the engine. A separator is operatively connected to the inlet. The separator is configured to remove particulate matter from the crankcase emissions. A treatment component is disposed downstream of the separator, and is configured to remove odor and toxic gases from the crankcase emissions. The apparatus further includes an outlet configured to release crankcase emissions that remain after processing by the separator and the treatment component.

In another embodiment, a method of reducing crankcase emissions generated by an engine includes removing particulate matter from the crankcase emissions. The step of removing the particulate matter includes receiving the crankcase emissions by a separator, removing the particulate matter from the crankcase emissions, and releasing the remaining crankcase emissions downstream to a treatment component. The treatment component removes odor and toxic gases from the remaining crankcase emissions. The step of removing odor and toxic gases includes receiving the remaining crankcase emissions by the treatment component, removing odor and gases from the remaining crankcase emissions, and releasing generally non-toxic emissions of the remaining crankcase emissions.

DETAILED DESCRIPTION

The following describes an improved apparatus that can generally reduce crankcase emissions generated by an engine, including for example particulate matter, odor, and/or toxic exhaust gases. One particular useful application for the apparatus described herein is to control and/or reduce particulate matter, gases, odor, and unregulated toxic emissions that may be contained in an engine crankcase blow-by gas stream, for example in open crankcase ventilation systems.

Regulatory organizations, such as the U.S. Environmental Protection Agency (EPA) and the California Air Resources Board, have identified a greater range of compounds which may pose considerable risk to the environment and public health. The EPA has developed a list of Mobile Source Air Toxics (MSAT) that contains a variety of compounds including fine particulate matter, aldehydes, and polycyclic organic matter (POM). Additionally, the Advanced Collaborative Emissions Study (ACES) program has identified more than 650 compounds which have been selected based upon established knowledge surrounding their toxicity and environmental impact.

Some examples of such MSAT compounds include but are not limited to, acetaldehyde, acrolein, arsenic compounds, benzene, 1,3-butadiene, chromium compounds, dioxins, furans, diesel particulate matter (DPM) and diesel organic gases (DEOG), ethylbenzene, formaldehyde, n-hexane, lead compounds, manganese compounds, mercury compounds, methyl tert-butyl ether (MTBE), naphthalene, nickel compounds, styrene, toluene, xylene, and polycyclic organic matter (POM). Some examples of POM include acenaphthene, chrysene, acenaphthylene, anthracene, dibenz (a,h) anthracene, fluoranthene, benz (a) anthracene, fluoranthene, fluorene, benzo (a) pyrene, indeno (1,2,3-cd) pyrene, benzo (b) fluoranthene, naphthalene, benzo (ghi) perylene, phenanthrene, benzo (k) fluoranthene, and pyrene. These compounds among others have been known to be toxic and to impact the environment.

The apparatus described herein may be employed in an emissions system, for instance in open crankcase ventilation systems of various engines, such as compression ignition and spark ignited internal combustion engines. The apparatus generally includes a separator that first removes particulate matter from the crankcase emissions, and includes a treatment component downstream from the separator that then reduces odor and removes certain toxic gases from the crankcase emissions. In the following exemplary embodiments, various separation mechanisms may be employed, including filters, coalescers, and impactors, and various catalytic mechanisms also may be employed. Such mechanisms may be employed in a number of configurations and arrangements to accomplish reducing such crankcase emissions.

Figure 1:
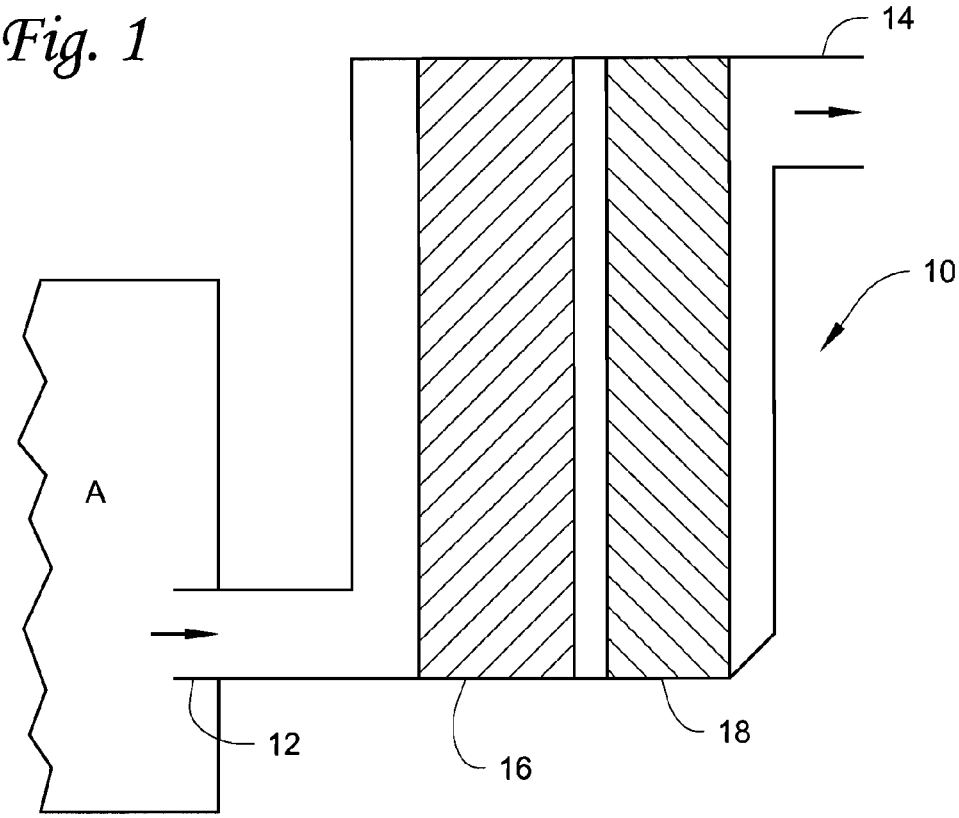
FIG. 1 shows a schematic plan sectional view of one embodiment of an apparatus for removing crankcase emissions.

FIGS. 1-5 illustrate several embodiments of an apparatus that controls and/or reduces crankcase emissions. FIG. 1 shows one embodiment of an apparatus 10 for removing crankcase emissions. The apparatus 10 includes an inlet 12. The inlet 12 is configured to receive crankcase emissions released from an engine (schematically depicted as A). A separator 16 is operatively connected to the inlet 12, such as by fluid communication where the inlet 12 provides access to the separator 16 (see arrow entering inlet 12). Generally, the separator 16 is configured to remove particulate matter, such as coarse, fine and ultra-fine mechanically and thermally generated particulate matter that is approximately less than 1.5 micron (coarse particulate matter), and even less than approximately 0.5 micron (fine and ultra-fine particulate matter). The separator 16 may also be configured to remove particle phase unregulated species, for example elemental carbon (EC), organic carbon (OC), trace elements, and polycyclic aromatic hydrocarbon and nitro-polycyclic aromatic hydrocarbon (PAH/n-PAH) material.

In one embodiment, the separator 16 may be structured and arranged as a coalescing element, such as may be known in the art. A suitable coalescing element may have a structure that allows smaller particulate matter to be collected, so that larger particles may then form and be trapped therein. Generally, the separator 16 may be any suitable filter structure or flow through material that can capture and remove particulate matter from the crankcase emissions. As one example, the separator 16 may be a separator used in a crankcase ventilation filtration assembly as may be known in the art for receiving crankcase emissions and filtering out particulate matter, such as oil mist and condensates. High efficiency separators (i.e. coalescer) have been known to reduce particulate matter that may be present in a blow-by gas stream by as much as 70%, and even as high as 95%.

In some embodiments, the separator 16 includes a certain media construction, such as a pleated or non-pleated filter or may be a foam based material such as polyurethane foam. The media may be configured such that, when the crankcase emissions enter inlet 12 and flow through the separator 16, coalescing of various particulate matter may take place within the media. It will be appreciated that the media is constructed to produce optimum results for coalescing the particulate matter at a high efficiency. It will be appreciated that the media of the separator 16 may be arranged and configured using various implementations such as may be known in the art of crankcase ventilation filtration, and its structure is not limited as long as the separation function can be accomplished.

In some examples, the coalescer element includes a filter media constructed of a gradient fiber structure that includes multiple fibers such as may be known in the art. The gradient fiber structure may be configured as multiple layers, where the coalescer includes fibers with a fineness that increases downstream from a side proximate the inlet 12 toward the side distal from the inlet 12.

Other examples of structures for coalescer elements can be found in U.S. Patent Application Publication No. US 2007-0062886 A1, which describes filter media coalescers and which is herewith incorporated by reference in its entirety. It will be appreciated that coalescers are well known in the art for coalescing and separating a medium having two immiscible phases, namely a continuous phase (i.e. blow-by gases that flow through) and a dispersed phase (particulate matter that is separated).

It will be appreciated that the coalescer element may be arranged and configured using other implementations as may be known in the art. Such other implementations may include, but are not limited to, wire mesh, screens, filters, or any other suitable coalescing structures. One of skill in the art will appreciate that the separator 16 is not limited to any particular structure or configuration, and will appreciate that various coalescing and impactor constructions and configurations may be employed for accomplishing the separating function.

As shown in FIG. 1, the separator 16 is followed by a treatment component 18. The treatment component 18 is disposed downstream from the separator 16, and is configured to remove exhaust odor and gases from the crankcase emissions. The treatment component 18 may be any suitable filter structure or flow through material as may be known in the art that can treat and remove odor and exhaust gases from the crankcase emissions. In one embodiment, the treatment component 18 is a filter or flow through structure having an adsorption material, in which such materials and principles of adsorption are briefly outlined below.

Adsorption is well known as a process that occurs when a gas or liquid solute accumulates on the surface of a solid or a liquid (adsorbent), forming a molecular or atomic film (the adsorbate). Similar to surface tension, adsorption is a consequence of surface energy. In a bulk material, for example, all the bonding requirements (be they ionic, covalent or metallic) of the constituent atoms of the material are filled. Atoms on the (clean) surface, however, can experience a bond deficiency, because they are not wholly surrounded by other atoms. Thus, it is energetically favorable for them to bond with (adsorb) other material, where the exact nature of the bonding and material adsorbed depends on the details of the species involved, but the adsorbed material is generally classified as exhibiting physisorption or chemisorption. Adsorption is indicative in most natural physical, biological, and chemical systems, and is widely used in industrial applications. As some examples, adsorption, ion exchange, and chromatography are sorption processes in which certain adsorptives are selectively transferred from the fluid phase to the surface of insoluble, rigid particles suspended in a vessel or packed in a column. In one desired application, adsorption can be used to control odor, non-polar substances, and organics including PAHs and particularly in engine exhaust aftertreatment systems.

Some common industrial adsorbents are activated carbon, silica gel, alumina, and zeolites, because they present enormous surface areas per unit weight. Activated carbon is produced by roasting organic material to decompose it to granules of carbon (i.e. coconut shell, wood, and bone are common sources). Silica gel is a matrix of hydrated silicon dioxide. Alumina is mined or precipitated aluminum oxide and hydroxide. Although activated carbon is a magnificent material for adsorption, its black color persists and adds a grey tinge if even trace amounts are left after treatment; however, filter materials with fine pores have been known to remove carbon quite well.

The adsorbents are used usually in the form of spherical pellets, rods, moldings or monoliths with hydrodynamic diameter between 0.5 and 10 mm. Preferably, the adsorbents have high abrasion resistance, high thermal stability and small micropore diameter, which results in higher exposed surface area and hence high capacity of adsorption. Adsorbents preferably have a distinct macropore structure which enables fast transport of the gaseous vapors. Many industrial adsorbents fall into one of three classes:

(1) Oxygen-containing compounds—which are hydrophilic and polar, including materials such as silica gel and zeolites; (2) Carbon-based compounds—which are hydrophobic and non-polar, including materials such as activated carbon; and (3) Polymer-based compounds—which are polar or non-polar functional groups in a porous polymer matrix.

By way of further background, a surface already heavily contaminated by adsorbates is not likely to have much capacity for additional binding. Freshly prepared activated carbon has a clean surface. For example, charcoal made from roasting wood differs from activated carbon in that its surface is contaminated by other products, but further heating will drive off these compounds to produce a surface with high adsorptive capacity. Although the carbon atoms and linked carbons are most important for adsorption, the mineral structure contributes to shape and to mechanical strength. Spent activated carbon can be regenerated by roasting, but thermal expansion and contraction eventually disintegrate the structure so some carbon is lost or oxidized.

In aftertreatment systems as described herein, the adsorbent material(s) can be contained in adsorber filters or canisters, such as carbon canisters which are well known. Such filters or canisters are flow through devices that carry out the adsorption function in aftertreatment systems.

Turning specifically back to the treatment component 18, the treatment component 18 in some embodiments may be an activated charcoal or activated carbon filter or canister. It will be appreciated that the treatment component also may include filter media such as a pleated, non-pleated, or bag based material as may be known in the adsorption filter art. In other embodiments, the treatment component 18 may be constructed as a non-pleated melt-blown polymer material. The filter or canister structure of the treatment component is meant to be non-limiting and may employ any filter and/or flow through structure so as to carry out the adsorption function as desired for a particular application.

In other embodiments, the adsorption material employed for the treatment component 18 may be silicon or a zeolite based flow through catalyst. For instance, surfaces of a filter or flow through structure for air may be loaded with an adsorption material (i.e. charcoal or activated carbon) to allow for adsorption of odorous materials (i.e. ammonia $NH_3$) and/or exhaust gases to occur on the treatment component. In some embodiments, the adsorption material is activated charcoal or silicon material. In some embodiments, the adsorption material may be nano-sized material disposed on a front face or upstream side of the treatment component 18 or disposed within the media of the treatment component 18.

In the example where charcoal is employed, the odorous material and/or exhaust gases (adsorbent) may bind with the charcoal, so that a molecular or atomic film (adsorbate) may form on surfaces of the filter or flow through structure. In such a configuration, odorous material and exhaust gases may be removed from the crankcase emissions.

It will be appreciated that various amounts of the adsorption material may be employed, and that one of skill in the art would recognize a suitable or optimum amount of the adsorption material to be used for a desired application. For further reference, U.S. Pat. Nos. 6,735,940, 6,745,560 and 6,820,414, which are incorporated herewith by reference in their entirety, describe some particular implementations of adsorbers and catalytic soot filters in aftertreatment systems and some general principles of the use of adsorption in such applications. As yet for further reference, U.S. Pat. No. 6,701,902 also generally describes activated carbon canisters, which is incorporated herewith by reference in its entirety.

After processing by the separator 16 and treatment component 18 has taken place, the remaining crankcase emissions may be released from the outlet 14 (see arrow), such as a vent hose. It also will be appreciated that the adsorption materials employed, such as activated charcoal and silicon, may be replaced or regenerated regularly. Certain maintenance intervals, such as an oil change, may be a good estimate period for when the adsorption material of an adsorption filter should be replaced or regenerated.

Regarding both the separator and treatment component, one of skill in the art will appreciate that the filter structures that may be employed for the separator and treatment component, may be constructed as replaceable components as may be known in the art.

As shown in FIG. 1, the apparatus 10 is configured such that a single housing contains the inlet 12, outlet 14, separator 16, and treatment component 18. One of skill in the art will appreciate that the apparatus 10 and any of the following apparatuses described may not be contained in a single housing, and will appreciate that separate housings may be employed for the separator 16 and treatment component 18 so that they are separate and distinct devices within the emissions system. In such an instance, the apparatus 10 may be constructed of separate devices for each of the separator 16 and treatment component 18, where they are operatively connected by suitable flow passages and connections so that the crankcase emissions may access each structure. For example, the separator 16 may be a crankcase filter assembly connected upstream from the treatment component 18, which may be any known vapor/fume adsorption filter known in the art. It will be appreciated that suitable connection structures for installing the apparatus within the emissions system, either as an all-in-one apparatus or as separate and distinct devices, are known in the art and need not be described. Various inlet and outlet connections, such as threaded connections may be employed as suitable connections.

Figure 2:
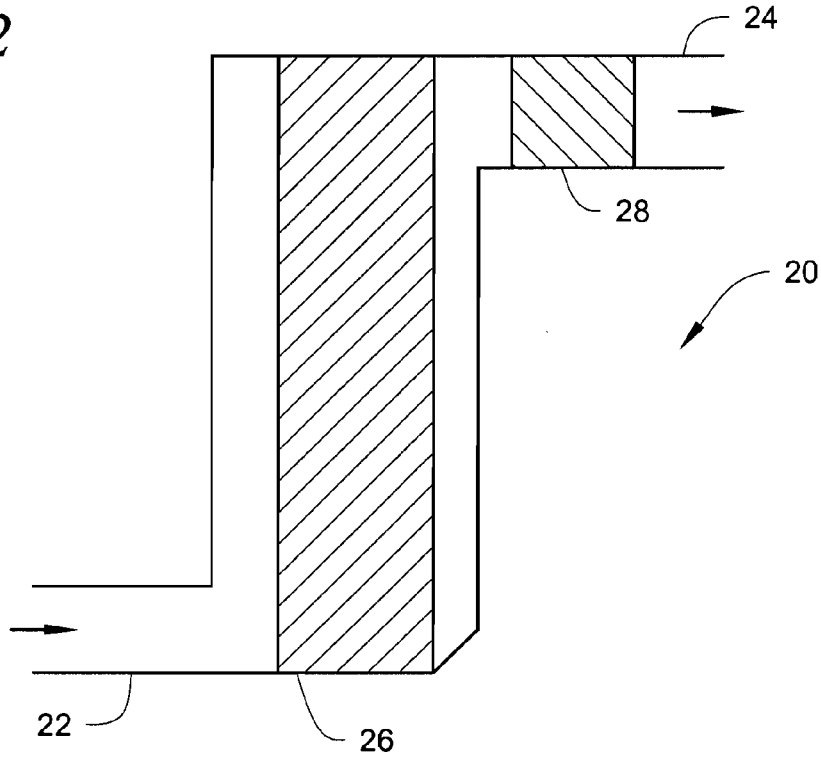
FIG. 2 shows a schematic plan sectional view of another embodiment of an apparatus for removing crankcase emissions.

FIG. 2 shows another embodiment of an apparatus 20 for removing crankcase emissions. Similar to the apparatus 10, an inlet 22 and outlet 24 are provided for apparatus 20 and are not further described. Apparatus 20 also includes a separator 26, which may be configured and arranged as separator 16. Differently from apparatus 10, a treatment component 28 is a flow-through oxidation catalyst (DOC) such as may be known in the art. For example, such known DOCs are flow-through honeycomb-like structured substrates, and often include a catalyst material coated on surfaces of the substrate. As with treatment component 18, treatment component 28 is disposed downstream from the separator 26. The treatment component 28 as a flow-through oxidation catalyst oxidizes certain emissions so as to reduce odorous material and hydrocarbon gas emissions. In one embodiment, the treatment component 28 is a filter or flow-through monolith structure coated with a precious metal. As one example only, the treatment component 28 may be a catalyst wash-coating including various precious metal(s), such as may be known in the art. As the crankcase emissions flow through the treatment component 28, the precious metal promotes reactions which oxidize the odorous material and hydrocarbon gases that may be present in the crankcase emissions.

In one embodiment, the treatment component 28 is disposed on an inner surface of the outlet 24. In some examples, the outlet 24 is structured and arranged as a tube, where the flow-through oxidation catalyst is incorporated therein.

Figure 3:
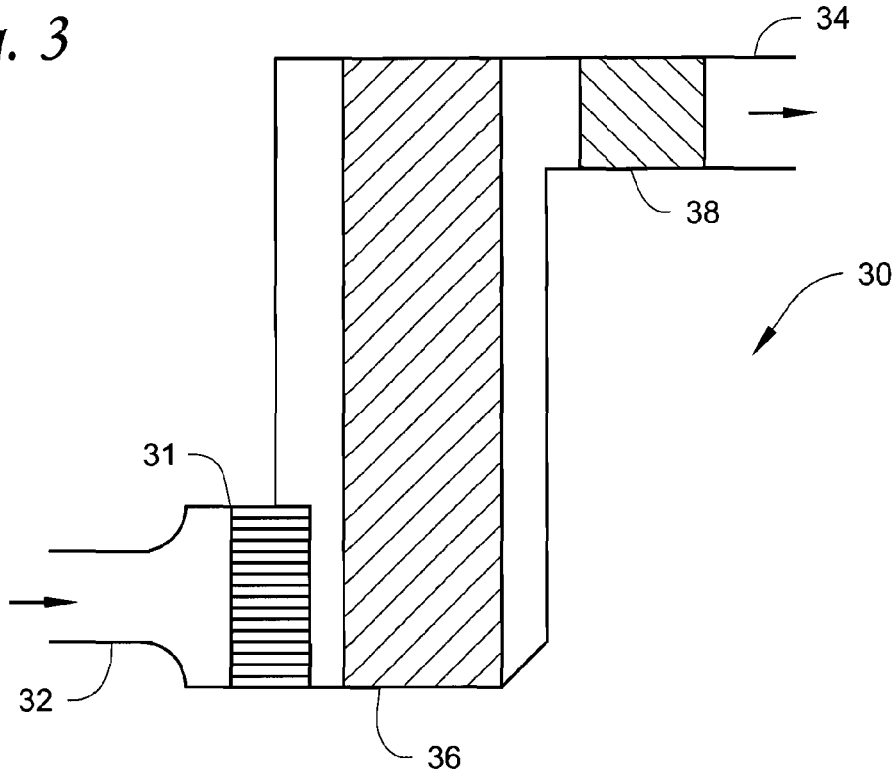
FIG. 3 shows a schematic plan sectional view of another embodiment of an apparatus for removing crankcase emissions.

FIG. 3 shows another embodiment of an apparatus 30 for removing crankcase emissions. Similar to the previous apparatuses described, an inlet 32 and outlet 34 are provided for apparatus 30 and are not further described. Apparatus 30 also includes a separator 36 similar to apparatuses 10, 20 and a treatment component 38 similar to apparatus 20. Differently from the previous apparatuses 10, 20, the apparatus 30 further includes an additional separator disposed proximate the inlet 32. In one embodiment, the separator is an impactor element 31 is disposed upstream relative to the separator 36. The impactor element 31 is configured to remove particulate matter, such as coarse, mechanically generated particulate matter, and may be structured as an impactor that may be known in the art, for example such impactors employed in crankcase ventilation systems. One of skill in the art will appreciate that the impactor element 31 may be incorporated into any of the apparatuses 10, 20 or any of the embodiments further described herein.

In one embodiment, the impactor element 31 is configured to allow flow through of the crankcase emissions and to provide an impact surface for the particulate matter entering the apparatus 30. For example, a suitable structure for an impactor element is one that can "get in the way of" or impact the flow of the crankcase emissions. Such a structure allows the impactor element 31 to first separate relatively coarse, mechanically generated particulate matter from the crankcase emissions before the remaining crankcase emissions continue flowing through the apparatus 30 to the separator 36 and the treatment component 34. Such a configuration may help increase capacity and durability of the apparatus 30.

As the blow-by gas stream enters the inlet 32, the impactor element 31 provides an impact surface for the blow-by fluids, and provides a surface for causing a change in their flow direction. As a result of such a change in flow direction, the impactor element 31 causes can cause coarse particulate matter to be separated from the blow-by gas stream, and allow remaining crankcase emissions to flow toward the separator 36 and treatment component. Some examples of a structure for an impactor element, which are well known, can be found in U.S. Pat. No. 7,238,216 which describes an inertial gas-liquid impactor for removing particles from a liquid gas stream, and which is herewith incorporated by reference in its entirety.

One of skill in the art will appreciate that the impactor element 31 is not limited to any particular structure or configuration, and will appreciate that various constructions and configurations may be employed for accomplishing the separating function desired.

In operation, the impactor element 31 first removes relatively coarse particulate matter, followed by removal of relatively fine and ultra-fine particulate matter and particle phase unregulated species by the separator 36, and then followed by removal of odorous material and certain gases by the treatment component 38 (i.e. catalyst-coated outlet, catalyst-coated blow-by tubes, or catalysts-coated flow-through monolith substrates). Such a configuration provides additional serial filtration of coarse particulate matter (impactor element), more fine and ultra-fine particulate matter (separator), and odorous and/or toxic gases (treatment component).

Regarding the catalyst for the treatment component in the embodiments of FIGS. 2 and 3, some embodiments apply the catalyst onto various surfaces of the treatment component, such as through a chemical coating as may be known in the art. In some embodiments, the chemical coating may be at least one of a ceramic washcoat or a glass-based coating, or chemical solution, or other carrier suitable for applying the chemical coating. Generally, other examples of the material for the chemical coating include a material that is at least one selected from the group consisting of a catalytic precious metal, a catalytic precious metal oxide, a non-catalytic precious metal, a catalytic base metal, and a catalytic base metal oxide. In some embodiments, the catalyst is formulated to include a catalyst material such as platinum (Pt) and/or palladium (Pd), mixtures of platinum and ruthenium (Ru) or rhodium (Rh) mixtures of platinum and palladium or other precious metals. For example, such mixtures in an oxidation catalyst may include Pt/Pd at 20-30/3-5 troy ounces (ozt).

It will be appreciated that, in any embodiment employing the catalyst wash coating, various amounts of the catalyst wash coat may be employed. As in a typical DOC, one of skill in the art would recognize a suitable or optimum amount, concentration, and/or density of which the catalyst wash coat should be applied depending on the particular use and application.

Figure 4:
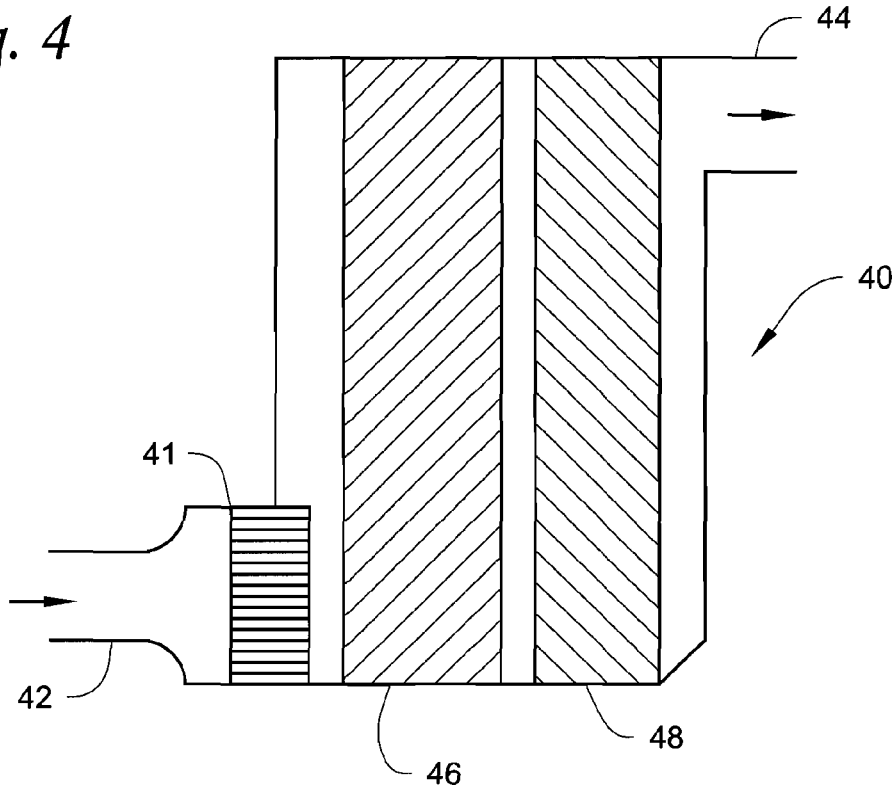
FIG. 4 shows a schematic plan sectional view of yet another embodiment of an apparatus for removing crankcase emissions.

FIG. 4 shows another embodiment of an apparatus 40 for removing crankcase emissions. Similar to the previous apparatuses described, an inlet 42 and outlet 44 are provided for apparatus 40 and are not further described. Apparatus 40 also includes a separator 46 similar to the previous apparatuses and a treatment component 48 similar to apparatus 10 (i.e. charcoal filter). In one embodiment, the apparatus 40 is similarly constructed as apparatus 10, but further including an impactor element 41 disposed proximate the inlet 42. The impactor element 41 may be structured and configured similarly as impactor element 31 of apparatus 30 and is not further described.

In operation, the apparatus 40 provides an impactor element 41 that first removes relatively coarse particulate matter, followed by removal of relatively fine and ultra-fine particulate matter and particle phase unregulated species by the separator 46, and then followed by removal of odorous material and certain gases by the treatment component 48 (i.e. charcoal filter).

Figure 5:
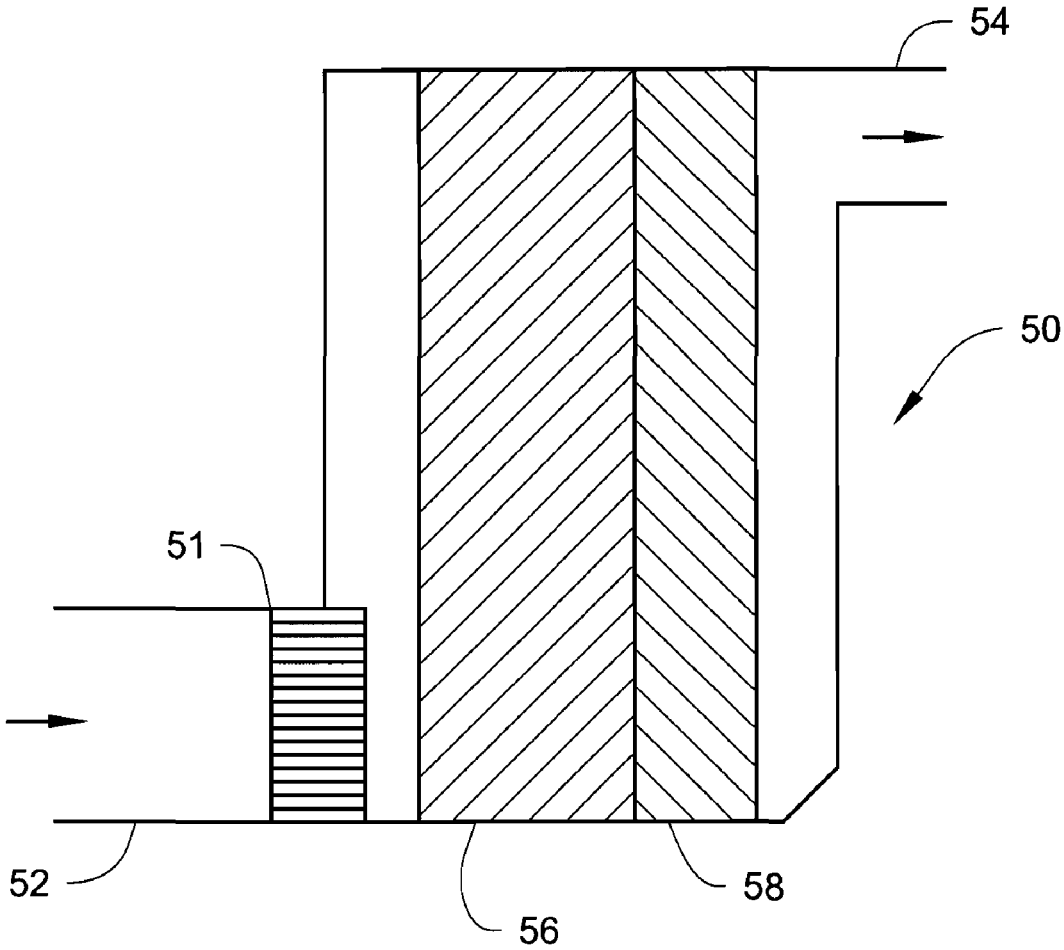
FIG. 5 shows a schematic plan sectional view of yet another embodiment of an apparatus for removing crankcase emissions.

FIG. 5 shows another embodiment of an apparatus 50 for removing crankcase emissions. Similar to the previous apparatuses described, an inlet 52 and outlet 54 are provided for apparatus 50 and are not further described. Apparatus 50 also includes a separator 56 similar to the previous apparatuses and an impactor element 51 similar to apparatuses 30, 40, which are not further described. As with the other apparatuses, the impactor element 51 is optional. One of skill in the art will appreciate that the impactor element 51 may not be employed in the apparatus 50 or in any of the previously described embodiments in which it is shown.

Differently from the previous embodiments, apparatus 50 includes a treatment component 58 disposed directly adjacent the separator 56. As with the previously described treatment components, treatment component 58 is configured to remove odor and exhaust gases from the crankcase emissions. In some examples, the treatment component 58 may be any suitable filter structure or flow through material disposed directly adjacent to the separator 56. In some embodiments, the treatment component 58 may be a separate and distinct structure that is positioned adjacent to the separator 56. In some instances, the treatment component 58 may be melt-blown polymer material and connected to the separator 56. In other embodiments, the treatment component 58 is another layer of media formed on the separator 56. For example, the separator 56 is constructed and arranged of a multi-layer flow through element, where an adsorption material (i.e. charcoal or activated carbon material) is embedded in one of the downstream layers of the media of the separator 56. In such a configuration, odorous material and exhaust gases may be treated and/or removed.

As previously described, the treatment component 58 may be a filter or flow through media structure including an adsorption material (i.e. charcoal or activated carbon material) loaded on the media structure. By loaded, the adsorption material may be disposed on the surface of the media, embedded within the media, or otherwise put on the media. For example, surfaces of a filter or flow through structure may be loaded with adsorption material to allow for adsorption of odorous materials (i.e. ammonia $NH_3$) and/or exhaust gases to occur on the treatment component. As described, the adsorption material in some embodiments is a charcoal/silicon material or otherwise is an activated carbon material. The odorous material and/or exhaust gases (adsorbent) may bind with the adsorption material, so that a molecular or atomic film (adsorbate) may form on surfaces of the filter or flow through structure. In such a configuration, odorous material and exhaust gases may be removed from the crankcase emissions.

In operation, the apparatus 50 may provide an impactor element 51 that first removes relatively coarse particulate matter, followed by removal of relatively fine and ultra-fine particulate matter and particle phase unregulated species by the separator 56, and then followed by removal of odorous material and certain gases by the treatment component 58 (i.e. charcoal filter disposed directly adjacent of the separator or as another layer of the separator).

While the embodiments illustrated in the figures show each apparatus with one separator and one treatment component (and with or without an impactor element), it will be appreciated that more than one separator and/or one or more treatment component may be employed as desired and/or necessary. For example, an apparatus may employ both a catalytic wash coat and a charcoal filter if such an implementation of a treatment component is desired and/or necessary.

The apparatus for reducing/controlling crankcase emissions can help engines comply with regulations for controlling particulate matter and gaseous emissions originating from a crankcase blow-by gas stream. The embodiments described herein provide an apparatus that can control odor from the crankcase blow-by gas stream, and may also reduce unregulated toxic emissions. The embodiments of an apparatus described herein may be employed in an emissions system of various engines, such as compression ignition and spark ignited internal combustion engines. More particularly, the apparatus described herein may be used in various open crankcase ventilation systems and their subsystems where removing certain emissions is desired and/or needed.

The apparatuses and methods described herein can reduce crankcase emissions as high as at least 70% efficiency in terms of reducing particulate matter and as high as at least 60% efficiency for reducing toxic odors and gas (i.e. hydrocarbon). Generally, apparatus designs with separators can have high efficiency in removing particulate matter at least as high as or greater than 70%. Likewise, apparatus designs with adsorption materials can have high efficiency in removing toxic odors and gases of at least as high as or greater 60%, and designs with oxidation catalysts can have high efficiency in removing toxic hydrocarbons at least as high as or greater than 60%.

The inventive concepts disclosed herein may be embodied in other forms without departing from the spirit or novel characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

The invention claimed is:

1. An apparatus for reducing crankcase emissions generated by an engine, comprising:

an inlet configured to receive crankcase emissions from the engine;

a separator operatively connected to the inlet, the separator configured to remove particulate matter from the crankcase emissions;

an impactor element disposed at the inlet and upstream of the separator, the impactor element configured to remove coarse, mechanically generated particulate matter;

a treatment component configured to remove odorous material and toxic gases from the crankcase emissions, the treatment component being disposed downstream of the separator; and an outlet configured to release crankcase emissions that remain after processing by the separator and the treatment component.

2. The apparatus of claim 1, wherein the separator comprising a filter configured to capture and remove the particulate matter from the crankcase emissions and configured to allow remaining crankcase emissions to flow through the filter.

3. The apparatus of claim 1, wherein the separator comprising a coalescing element, the coalescing element including a media configured to capture and remove the particulate matter from the crankcase emissions and configured to allow remaining crankcase emissions to flow through the coalescing element.

4. The apparatus of claim 1, wherein the particulate matter comprising coarse, fine, ultra-fine mechanically, thermally, and chemically generated particulate matter.

5. The apparatus of claim 4, wherein the particulate matter comprises an average particulate matter size of less than 1.5 micron.

6. The apparatus of claim 1, wherein the treatment component comprising a filter element configured to capture and remove odorous material and toxic gases from the crankcase emissions and configured to allow remaining crankcase emissions to flow through the filter element.

7. The apparatus of claim 6, wherein the filter element includes an adsorption material.

8. The apparatus of claim 7, wherein the adsorption material includes charcoal or activated carbon material.

9. The apparatus of claim 1, wherein the treatment component comprising a catalyst wash-coating disposed within the apparatus, the catalyst wash-coating including at least one precious metal suitable for use as an oxidation catalyst.

10. The apparatus of claim 9, wherein the catalyst wash-coating is disposed on at least one of an inner surface of the outlet and on a surface of a filter.

11. The apparatus of claim 1, wherein the treatment component is disposed directly adjacent of the separator, where the treatment component is connected at a downstream side of the separator.

12. The apparatus of claim 1, wherein the treatment component comprises an adsorption material embedded on a downstream side of the separator.

13. The apparatus of claim 1, wherein the separator and the treatment component being contained in a single housing.

14. A method of reducing crankcase emissions generated by an engine, comprising:

removing coarse, mechanically generated particulate matter from the crankcase emissions, removing the coarse, mechanically generated particulate matter including receiving the crankcase emissions by an impactor element disposed at an inlet, removing the coarse, mechanically generated particulate matter from the crankcase emissions, and releasing a first remaining crankcase emissions to a separator downstream;

removing particulate matter from the first remaining crankcase emissions, removing the particulate matter including receiving the first remaining crankcase emissions by the separator, removing the particulate matter from the first remaining crankcase emissions, and releasing a second remaining crankcase emissions to a treatment component downstream; and removing odorous material and toxic gases from the second remaining crankcase emissions, removing the odorous material and toxic gases including receiving the second remaining crankcase emissions by the treatment component, removing the odorous material and toxic gases from the second remaining crankcase emissions, and releasing generally non-toxic emissions of the remaining crankcase emissions.

15. The method of claim 14, wherein the step of removing particulate matter comprising coalescing the particulate matter by the separator to capture and remove the particulate matter.

16. The method of claim 14, wherein any of the steps of removing particulate matter and odorous material and toxic gases comprising removing particulate matter having a size of less than about 0.5 micron.

17. The method of claim 14, wherein the step of removing odorous material and toxic gases comprising adsorbing the odorous material and toxic gases with an adsorption material.

18. The method of claim 14, wherein the step of removing odorous and toxic gases comprising treating the remaining crankcase emissions with a catalyst wash coating, the catalyst wash coating including a precious metal.

* * * * *